United States Patent [19]

Bussiere et al.

[11] Patent Number: 5,022,657

[45] Date of Patent: Jun. 11, 1991

[54] GOLF PRACTICE TEE APPARATUS

[75] Inventors: Joseph P. Bussiere; Richard A. Bussiere; Paul L. Bussiere; Daniel J. Bussiere, all of Edmonton; Christopher Lindop, Alberta, all of Canada

[73] Assignee: 373470 Alberta Ltd., Edmonton, Canada

[21] Appl. No.: 579,692

[22] Filed: Sep. 10, 1990

[51] Int. Cl.[5] ..... A63B 57/00

[52] U.S. Cl. ..... 273/201

[58] Field of Search ..... 273/201

[56] References Cited

U.S. PATENT DOCUMENTS

| | | | |
|---|---|---|---|
| 1,545,959 | 7/1925 | Huyler | 273/201 |
| 1,965,697 | 7/1934 | Gardner et al. | 273/201 |
| 2,051,253 | 8/1936 | Goehler et al. | 273/201 |
| 2,127,282 | 8/1938 | Beckett | 273/201 |
| 2,295,599 | 9/1942 | Mozel | 273/201 |
| 3,147,980 | 9/1964 | Gollahon | 273/201 |
| 3,423,097 | 1/1969 | Fry | 273/201 |
| 3,966,213 | 6/1976 | Bradley | 273/201 |
| 4,659,081 | 4/1987 | Cook | 273/201 |
| 4,817,955 | 4/1989 | Hickson et al. | 273/201 |

*Primary Examiner*—Theatrice Brown

*Attorney, Agent, or Firm*—Anthony R. Lambert

[57] ABSTRACT

The apparatus is comprised of a platform with a teeing mechanism operated by a user. The user depresses a lever arm that depresses a tee and that activates a dispensing mechanism that feeds golf balls to the tee in its depressed position. The mechanism is comprised of a set of levers, a ratchet and an axle which extends into a reservoir of gold ball dispenser. The reservoir includes a hole leading to a chute that terminates at a vertical tube in which moves a depressible tee. On the axle, within the reservoir, is a flexible rotating disk with a plurality of oval holes. As the disk rotates, balls in the reservoir fall into the holes, and as the holes pass over the hole in the reservoir, the balls fall into the chute and onto the tee. The ratchet coordinates the motion of the flexible disk so that one ball is moved into position over the hole in the reservoir for each depression of the tee.

7 Claims, 4 Drawing Sheets

GOLF PRACTICE TEE APPARATUS

FIELD OF THE INVENTION

This invention relates to apparatus for practising golf.

BACKGROUND OF THE INVENTION

There have been many prior proposals relating to such apparatus, but they have not achieved widespread use. It has been proposed hitherto to make use of a reservoir of balls which are presented one at a time to the player by means of a teeing mechanism. Examples of such arrangements are to be seen, for example, in the following patents: U.S. Pat. No. 4,659,081; U.S. Pat. No. 3,378,263; U.S. Pat. No. 3,298,694; U.S. Pat. No. 3,533,631; and U.S. Pat. No. 2,711,321.

Such mechanisms have practical disadvantages. Many are unduly complex and expensive, are not readily transportable, require frequent service or maintenance, suffer degradation of performance due to wear and tear of the elements, and require connection to external sources of power. Others are simpler but would be difficult or inconvenient to operate or would not provide long term reliable performance.

SUMMARY OF THE INVENTION

An object of this invention is to provide a golf practice apparatus which is relatively inexpensive to manufacture and simple to use, which can be used both indoors and outdoors, which requires little maintenance and resists the elements, providing long term reliable delivery of golf balls without frequent service and which requires no external power supply.

According to one aspect of the invention there is provided an automatic golf tee comprising:

a user activated depressible tee movable from a first position to a second position;

a golf ball dispenser having a lower surface;

a golf ball sized hole formed in the lower surface of the golf ball dispenser;

a chute attached to the golf ball dispenser for supplying balls to the tee;

a flexible rotating disc having a plurality of openings arranged circumferentially about the disc, the flexible rotating disc being rotatably disposed above and adjacent to the lower surface of the golf ball dispenser, such that upon rotation the openings in the flexible rotating disc sequentially align up with the hole in the golf ball dispenser to allow any golf balls in the golf ball dispenser to enter the chute; and means for rotating the flexible rotating disc in response to the movement of the tee from the first position to the second position.

In other embodiments, the invention includes a cone disposed above the flexible rotating disc for deflecting any golf balls in the golf ball dispenser radially towards the opening; the means for rotating the flexible rotating disc including an axle having first and second ends, the first end being attached to the center of the flexible rotating disc, bearing means for rotatably receiving the axle, a circular ratchet attached to the second end of the axle, and a sequence of levers mechanically connected between the tee and the ratchet; the openings each being oval in shape; an artificial grass surface located adjacent the tee; means for automatically resetting the tee from the second position to the first position; and the depressible tee being fixed to a piston, the piston being bevelled on one of its sides.

BRIEF DESCRIPTION OF THE FIGURES

An embodiment of the invention will now be described, by way of example, with reference to the drawings, in which like numerals denote like elements and in which.

DESCRIPTION OF PREFERRED EMBODIMENT

Figure 1:
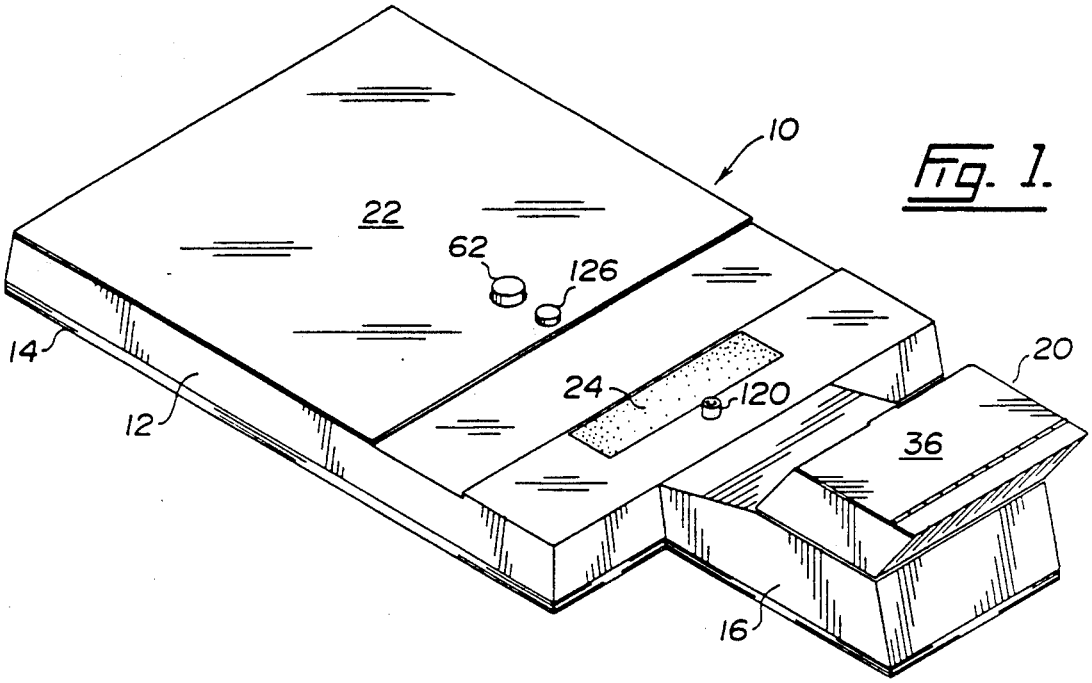
FIG. 1 is a general isometric view of an apparatus according to the invention.

Referring to FIG. 1, the apparatus has a platform assembly generally designated 10, and an upper framework generally designated 12 which is connected by support members 32 to the lower framework 16 mounted on ground-engaging surface or feet 14. The framework 12 is of such dimensions that it can be stepped onto easily by a person standing on the ground. The platform 10 could be manufactured such that several such platforms could form one integral unit served by one or more reservoirs or golf ball dispensers 20. Platform 10 could be fitted with a ramp for wheelchair use or, with a vertically mounted brace or seat to permit handicapped individuals to utilize the invention. Weight sensors may be placed upon the surface of platform 10 for use in educating users of the invention on proper standing position. Further, platform 10 may be incorporated into the floor of a building or structure.

Referring to FIG. 1, the platform 10 is associated with a reservoir 20. The reservoir 20 is used to hold a sufficient volume of golf balls to avoid frequent loading of baskets of golf balls by operators, and may be any of various suitable shapes such as trapezoidal as shown, or shaped for the promotion of other products such as beverages. The reservoir 20 may be detachable so that it may be replaced with reservoirs of various promotional shapes.

The apparatus may be coin operated so as to permit operation of the mechanism only upon presentation of a coin or token. The apparatus could include a counter-mechanism which would permit the operators to charge users by the number of balls used. Further, the reservoir 20 could be used to feed multiple platforms.

The platform 10 includes a standing area covered with a slip-resistant surface 22, such as synthetic grass, rubber matting or the like. In the preferred embodiment the surface 22 is water-resistant and may contain drain holes which penetrate through platform 10 to permit drainage of water from the platform 10. Such a surface may be PRO'S CHOICE made of 76000 denier yarn, with a woven interliner and tufted 5/32" gauge fabric construction, available from Playfield Industries, of Chatsworth, Georgia.

A commercially available synthetic brush or turf 24 may be placed on the platform 10 adjacent the tee area 26, so that the user to play the ball off a turf-like surface rather than off of a tee. The turf surface may be obtained from Calgary Brush, of Calgary, Alberta, Canada. Such an adaptation would permit the user to use irons or other golf clubs which are not primarily suitable for use with a golf tee.

Reservoir 20 is supported by collar 132 which connects reservoir 20 to platform 10. Collar 132 may be an aluminum ring.

Figure 2:
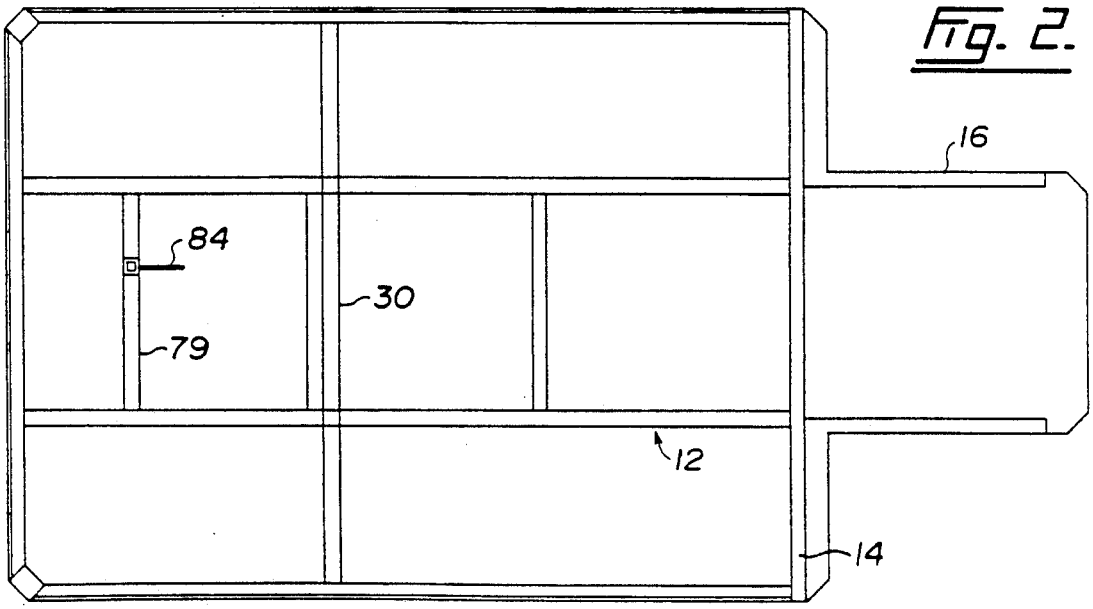
FIG. 2 is a schematic underside view of the platform of FIG. 1.

Referring to FIG. 2, platform 10 is shown in its preferred embodiment in an underview which discloses use of structural members 30 to provide bracing and support for platform 10. Such structural members may also be used to provide means of attachment of platform 10 to reservoir 20. The structural members 30 should be a rigid material which resists deterioration or exposure to the elements, such as plastic, treated wood, painted steel or alloys.

Figure 3:
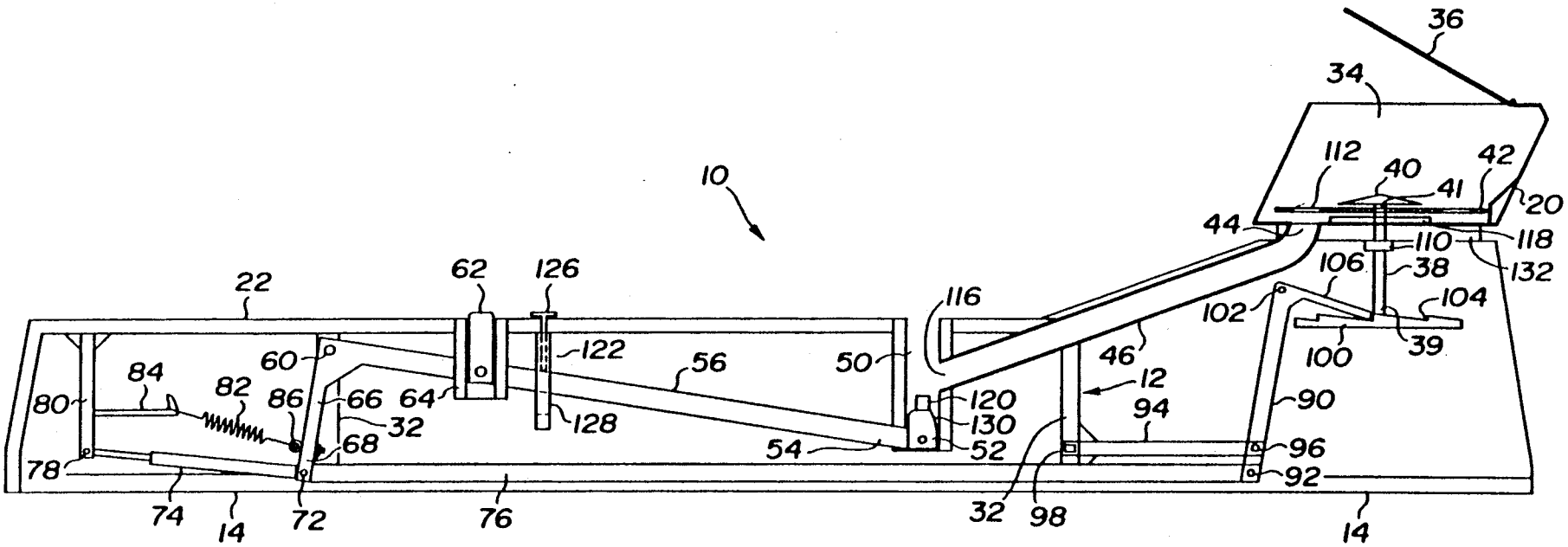
FIG. 3 is a detailed side cross-section of the platform seen in FIG. 1.
Figure 5:
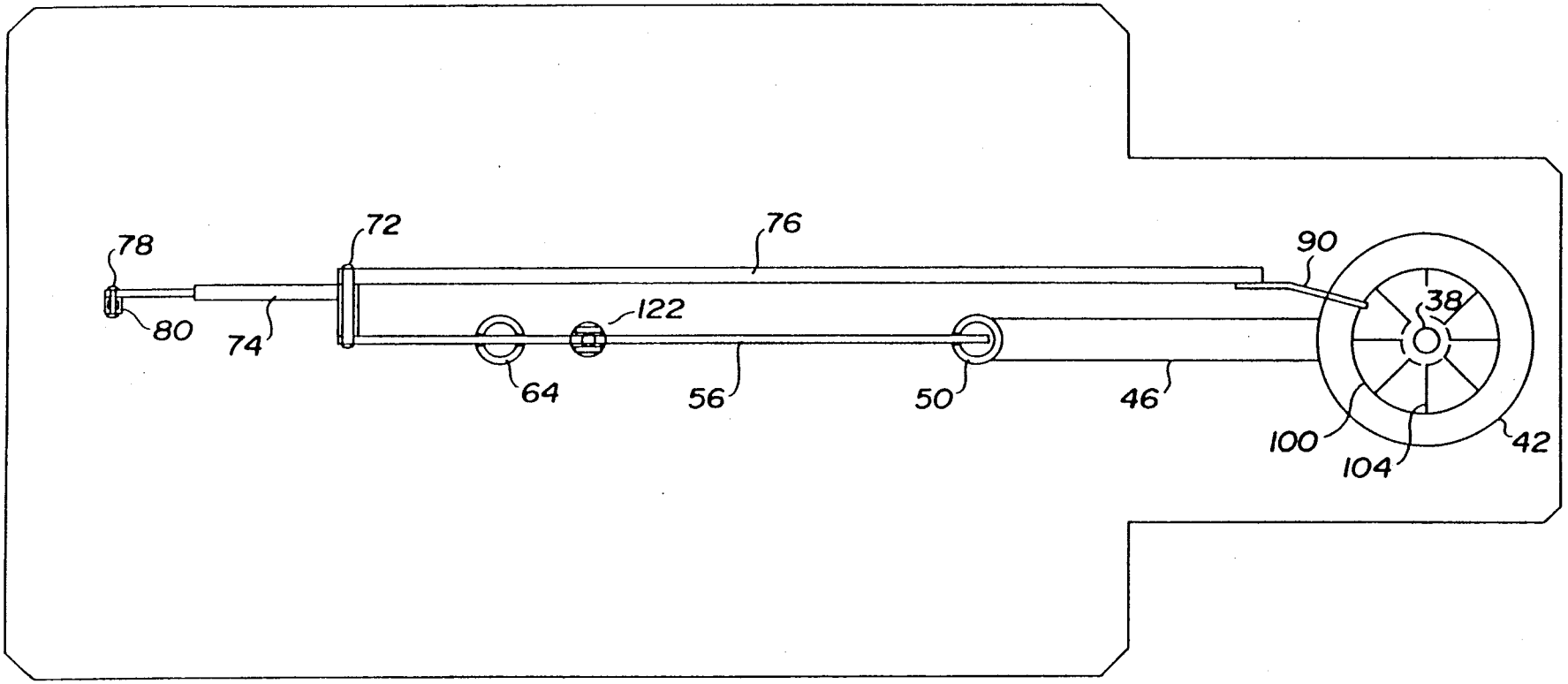
FIG. 5 is an end view of the platform of FIG. 1, cut way to show the internal mechanism of the apparatus.

Referring to FIG. 3, the platform 10 is shown in schematic side cross-section showing preferred vertical placement of support members 32. FIG. 5 shows an end view of the structural support of the platform.

FIG. 3 also shows a detailed side cross-section of the platform 10 and reservoir 20, a number of golf balls are placed into reservoir 20 through the open top 34. The open top 34 is sealable with hinged lid 36 shown in FIG. 1. A cone 40 attached to one end 41 of an axle 38 is set at a low position within the reservoir 20 and causes the golf balls to be directed towards the outer edges of reservoir 20 and to engage flexible disk 42, which is made of a flexible resilient material such as rubber.

The reservoir 20 includes an opening or hole 44 through which golf balls may fall into tee feed tube or chute 46. The tube 46 is shown here as a cylinder, but may be constructed of suitably arranged rods. Tube 46 terminates in the well 50, which contains depressible tee carrier 52 having tee 120 mounted on it. As the tee carrier 52 is depressed by the user using plunger 62 from the tee off position shown in FIG. 3, a ball in the chute moves onto the tee and the supply of balls in the chute is replaced by activation of the mechanism described in the following.

Means are provided for rotating the flexible rotating disc in response to the movement of the tee from the tee off position to the depressed position. This means is shown in detail in FIGS. 3 and 4. The means for rotating the flexible rotating disc includes: an axle 38 having first end 41 and second end 39, the first end 41 being attached to the center of the flexible rotating disc 42; bearing means 110 for rotatably receiving the axle 39; a circular ratchet or disc drive 100 attached to the second end 39 of the axle 38; and a sequence of levers mechanically connected between the tee 120 and the ratchet 100.

The sequence of levers operates as follows. The tee carrier 52 is pivotally attached by any suitable means to the end 54 of the main drive arm 56. The main drive arm 56 is L-shaped and is pivotally attached to a suitable one of platform support members 32 with pivot assembly 60. The plunger 62 is attached to the main drive arm 56 and is preferably detachable for adjustment or replacement. The tee carrier 52 is also preferably detachable, and bevelled on the side facing the feed tube 46. Plunger 62 is slidably disposed in plunger shaft 64. End 68 of vertical leg 66 is attached at pivot 72 to gas shock 74 and also to arm 76. Tension spring 82 extends between the support bracket 80 and the vertical leg 66, and on one end is attached to the support bracket 80 (shown in FIG. 2) by hook 84 and on the other end to vertical leg 66 by eye hook 86. Support bracket 80 is suspended from the upper framework 12, as shown in FIG. 3.

When plunger 62 is depressed into plunger shaft 64 it forces the main drive arm 56 to pivot downwards and causes the tee carrier 52 to lower inside the tee well 50 and also causes the vertical leg 66 of main drive arm 56 to arch rearwards and upwards on platform 10 thereby compressing gas shock 74. Gas shock 74 is of a commercially available kind and it may be selected to provide the desired compressive force. Gas shock 74, together with the tension spring 82, drive arm 56 with leg 66, and their pivots, together constitute means for automatically resetting the tee from the depressed position to the tee off position.

Gas shock 74 is suspended between vertical leg 66 and support bracket 80, to which it is connected at pin 78. The resistive force of gas shock 74 may be adjusted through tension spring 82, which may be adjusted by rotation of the eye hook 86. In this manner, the speed at which the tee carrier 52 moves in the well 50 may be adjusted so that balls do not fall off the tee 120.

Vertical leg 66 is connected to a horizontal push arm 76 at pivot 72 and is pulled rearwards by the motion of the vertical leg 66 when plunger 62 is depressed into plunger shaft 64. The other end of horizontal push arm 76 is attached to vertical drive arm 90 at pivot assembly 92, which in turn is attached to drive support arm 94 at pivot assembly 96. Drive support arm 94 is fastened to a platform support member 32 (shown in FIG. 3) at 98.

When horizontal push arm 76 is pulled rearwards (to the left in the drawing), it pulls the lower end of vertical drive arm 90 rearwards causing the upper end of vertical drive arm 90 to pivot about pivot 96 and move forwards. -Disk drive arm 106 is attached to the top of vertical drive arm 90 with pivot assembly 102. When the upper end of the vertical drive arm 90 is pushed forwards, it in turn pushes disk drive arm 106 forwards causing the end of it to engage against cogs 104 on disk drive 100 causing disk drive 100 to rotate.

Figure 4:
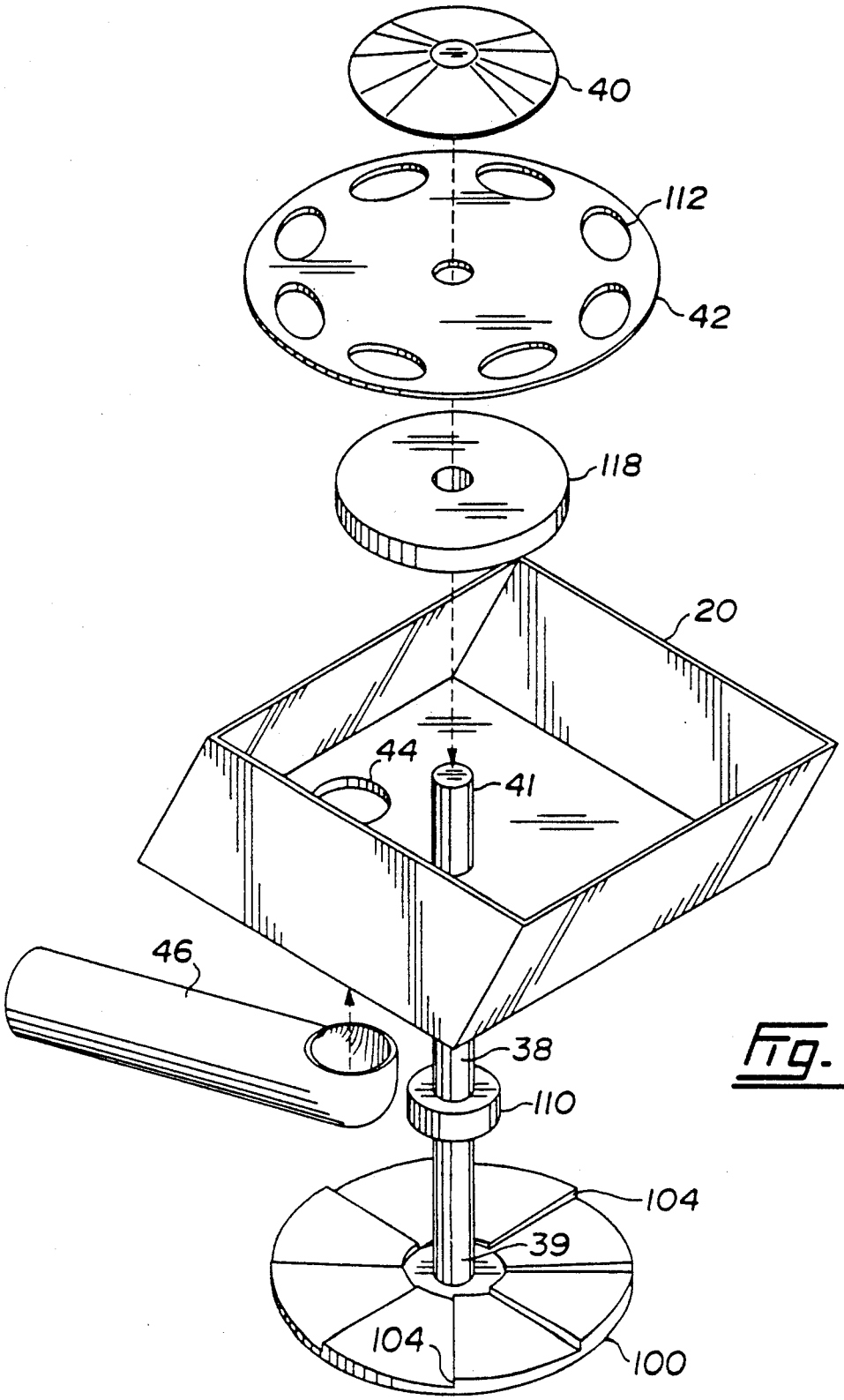
FIG. 4 is an exploded perspective view of a flexible rotating disc and axle according to the invention.

Referring particularly to FIGS. 3 and 4, the lower end of axle 38 is attached through the center of disk drive 100 and is secured to platform 10 with a bearing assembly 110 and to the flexible disk 42 with cone 40 attached to the first end 41 of axle 38. When disk drive 100 rotates, it causes the axle 38 to rotate as well as rotating flexible disk 42 along with cone 40. Referring particularly to FIG. 5, flexible disk 42 has a number of oval shaped holes 112. As flexible disk 42 rotates, the golf balls are moved towards tee feed hole 44 which is provided at the bottom of reservoir 20. During the rotation of flexible disk 42, one of the oval shaped holes 112 aligns with tee feed hole 44 in the bottom of reservoir 20 allowing a golf ball to pass into the tee feed tube or chute 46 which is on a decline towards well 50. When an oval shaped hole 112 in the flexible disc 42 is aligned with tee feed hole 44 it is possible for more than one golf ball to pass into the tee feed tube 46 and when the tee feed tube 46 is full, with golf balls protruding from the top of the chute, it is possible for the flexible disk 42 to continue its rotation as it is fabricated from a pliable resilient material allowing it to bend upwards over the golf balls that are still in reservoir 20.

The rotational motion of disc drive 100 is transmitted to the flexible disc 42 and cone 40, which are each rigidly attached to disk drive 100 by means of axle 38. Axle 38 passes through bearing assembly 110 to provide relatively frictionless rotation. Reservoir 20 is full of golf balls. The function of cone 40 is to place the balls onto disc 42 in the proper position, that is, near the oval holes 112. Cone 40 also supports the weight of the balls in reservoir 20 which takes the weight off disc 42. Cone 40 also holds disc 42 down and in proper position. Cone 40 takes most of the force of impact of golf balls being loaded into reservoir 20. The angle of cone 40 is in the preferred range of 10 degrees to 20 degrees and depends on the height of reservoir 20 and the amount of weight to be supported. A steeper angle will support less weight.

A spacer 118 is provided between the flexible disc 42 and the lower surface 28 of the reservoir 20 to raise the height of the flexible disc 42 above the lower surface so that it is about at the height of the middle of a golf ball. This permits the flexible disc to fairly readily move the golf balls around the reservoir 20.

A less preferred form of the flexible disc 42 could include a series of rods or rubber fingers to move golf balls around lower surface of reservoir 20. Flexible disc 42 does not require service whereas rods, rubber fingers or similar mechanisms could bend or jam requiring frequent service or adjustment.

Oval holes 112 are used in the disc since it has been found that they provide more time for the golf ball to drop into the hole than round holes. The number of holes depends on the size of the reservoir. If a larger reservoir is desired then more holes should be used.

The flexible disc 42 is a very effective feeding mechanism which acts to force the golf balls around the bottom surface of reservoir 20. The holes 112 in disc 42 are designed to correspond to cogs 104 so that the holes pass over and stop near the top opening 44 of feed tube 46 as they move around the reservoir. As a result golf balls moving around the bottom surface of reservoir 20 drop, by force of gravity, into feeder tube 46. Feeder tube 46 quickly fills up, thereby providing a continuing source of golf balls to tee carrier 52. The golf balls in feeder tube 46 are automatically fed to tee carrier 52 by the force of gravity.

When a golf ball is moved into position over the hole 44, it rolls down the tee feed tube 46. Normally, the feed tube will be full and the golf ball will sit on top of the other golf balls in the tube. When the tee carrier 52 is in the depressed position, one golf ball will roll into the well 50 through an opening 116 in the side of the well 50 that connects to tee feed tube 46. The golf ball will roll onto tee 120 by the appropriate positioning of the tee 120 on the tee carrier 52 in the well 50.

When the plunger 62 is depressed, and the tee carrier 52 is in its lower position, the release of the plunger 62 decompresses gas shock 74 which in turn pushes vertical leg 66 and hence main drive arm 56 forwards. This motion resets disk drive arm 76 into its start position as well as raising plunger 62 up to its original start position while raising tee carrier 52 into its tee off position. The height of tee 120 may be adjusted by turning the tee adjuster 122. The tee adjuster 122 may be formed from a tee adjuster knob 126 having a threaded end set in a guide 128. Guide 128 is formed from a pair of steel members that receive the main drive arm 56 between them and constrain the main drive arm 56 to move in a vertical plane. The threaded end of the tee adjuster knob 126 forms a stop that limits the upward motion of main drive arm 56 at different positions.

The user then hits the golf ball off tee 120 directly or places it onto artificial turf surface 24 which permits the user to play the ball off a turf like surface rather than off a tee. At this point, the user may then depress plunger 62 to re-initiate the process.

The tee carrier 52 is preferably bevelled as shown at 130. This facilitates the pushing back of balls in the tube 46 as the tee carrier 52 moves back into the tee off position.

While a preferred embodiment of the invention has been described, immaterial changes may be made to the embodiments described without departing from the essence of the invention.

We claim:

1. An automatic golf tee comprising:

a user activated depressible tee movable from a first position to a second position;

means actuable by a user for actuating said tee;

a golf ball dispenser having a lower surface;

a golf ball sized hole formed in the lower surface of the golf ball dispenser;

a chute attached to the golf ball dispenser below said hole in said lower surface for supplying balls to the tee;

a flexible rotating disc having a plurality of openings arranged circumferentially about the disc, the flexible rotating disc being rotatably disposed above and adjacent to the lower surface of the golf ball dispenser, such that rotation of the flexible disc to sequentially align said opening in said disc with the hole in the golf ball dispenser allows a golf ball in the golf ball dispenser to enter the chute; and means connecting said means actuable by a user and said rotating disc for sequentially rotating the flexible disc in response to movement of the tee from the first position to the second position.

2. The automatic golf tee of claim 1 further including a cone disposed above the flexible disc for deflecting any golf balls in the golf ball dispenser radially towards the openings.

3. The automatic golf tee of claim 1 in which the means for rotating the flexible disc includes:

an axle having first and second ends, the first end being attached to the center of the flexible disc;

bearing means in said lower surface for rotatably receiving the axle;

connecting said means actuable by a user and sold rotating disc a circular ratchet attached to the second end of the axle drive means engaging said rachet to rotate said disc when said tee is actuated by a user, and a sequence of levers connected between the tee and drive means.

4. The automatic golf tee of claim 1 in which the openings are each oval in shape.

5. The automatic golf tee of claim 1 further including an artificial turf surface located adjacent the tee.

6. The automatic golf tee of claim 1 further including means for automatically resetting the tee from the second position to the first position.

7. The automatic golf tee of claim 1 in which the depressible tee is fixed to a tee carrier, the tee carrier being bevelled at its top end.

* * * * *